US006163107A

United States Patent [19]

Itoh et al.

[11] Patent Number: 6,163,107

[45] Date of Patent: Dec. 19, 2000

[54] FIELD EMISSION CATHODE

[75] Inventors: Shigeo Itoh; Takahiro Niiyama; Masaharu Tomita; Yoshitaka Kagawa; Akira Inoue, all of Mobara; Junji Itoh; Seigo Kanemaru, both of Tsukuba, all of Japan

[73] Assignees: Futaba Denshi Kogyo K.K., Mobara; Director General Agency of Industrial Science and Technology, Tokyo, both of Japan

[21] Appl. No.: 09/037,035

[22] Filed: Mar. 9, 1998

[30] Foreign Application Priority Data

Nov. 3, 1997 [JP] Japan ..... 9-072841
Nov. 8, 1997 [JP] Japan ..... 9-216160

[51] Int. Cl.[7] ..... H01J 1/30

[52] U.S. Cl. ..... 313/495; 313/336; 313/351; 313/309; 313/497

[58] Field of Search ..... 313/309, 336, 313/351, 495, 497; 315/169.3

[56] References Cited

U.S. PATENT DOCUMENTS 3,755,704 8/1973 Spindt et al. ..... 313/309
4,513,308 4/1985 Greene et al. ..... 313/309
4,766,340 8/1988 Van Der Mast et al. ..... 313/309
4,908,539 3/1990 Meyer ..... 315/169.3
5,173,634 12/1992 Kane ..... 313/309
5,448,133 9/1995 Ise ..... 313/309
5,550,435 8/1996 Kuriyama et al. ..... 313/336
5,965,972 10/1999 Takada et al. ..... 313/309

*Primary Examiner*—Ashok Patel
*Attorney, Agent, or Firm*—Oblon, Spivak, McClelland, Maier & Neustadt, P.C.

[57] ABSTRACT

A field emission cathode that can uniform the number of electrons emitted from each emitter and can prevent a line defect even when a gate electrode is electrically short-circuited with an emitter. The movement of electrons in a channel formed on the channel forming electrode is controlled by applying a positive voltage to the current control electrode, so that the current supplied from the cathode electrode to the emitter can be controlled. If the emitter is short-circuited with the gate electrode, the increased current density destroys the channel, so that the current supply to the emitter can be stopped.

18 Claims, 9 Drawing Sheets

FIELD EMISSION CATHODE

BACKGROUND OF THE INVENTION

1. Field of the Invention

This invention relates to a field emission cathode known as a cold cathode.

2. Description of the Related Art

When the electric field at a surface of a metal or semiconductor is as large as $10^9$ V/m, electrons pass through the potential barrier because of the tunnel effect, thus entering an evacuated space at room temperatures. This phenomenon is called field emission. The cathode for emitting electrons under such a principle is referred to as a field emission cathode (FEC) or a field emission element.

Recently, a plane-type field emission cathode formed of micron-size field emission elements could have been fabricated by fully using the semiconductor microprocessing techniques. The structure, in which plural field emission cathodes are arranged on a cathode substrate, can be used as electron supplying means for flat display devices or various electronic devices because emitters therein can radiate electrons onto the fluorescent surface.

FIG. 14 is a perspective view showing a field emission cathode called a Spindt type cathode (hereinafter sometimes referred to as FEC) as an example of the above-mentioned field emission cathode. Referring to FIG. 14, a cathode electrode layer 101 is formed on a cathode substrate 100. A resistance layer 102, an insulating layer 103, and a gate electrode 104 are sequentially formed over the cathode electrode layer 101. Then, cone emitters 115 are respectively formed in openings formed in the gate electrode layer 104 and the insulating layer 104. The tip of each cone emitter 115 is viewed from the opening in the gate electrode layer 103.

In the FEC, the cone emitter 115 and the gate electrode layer 104 can be spaced on the order of submicrons by using a microprocessing technique for fabricating integrated circuit devices. Consequently, the emitter can emit electrons when a low voltage of several ten volts is applied between the emitter 115 and the electrode 104.

As shown in FIG. 14, the anode substrate 116, on which a fluorescent substance layer is coated, is disposed above the cathode substrate 100 on which plural field emission cathodes are formed in a matrix pattern. In the display device, electrons can be emitted by applying the voltage $V_{GE}$ and the voltage $V_A$, thus glowing the fluorescent substance layer.

The reason that the resistance layer 102 is disposed between the emitter 115 and the cathode electrode layer 102 is as follows:

In the Spindt-type field emission cathode, since the spacing between the emitter 115 and the gate electrode layer 104 is set to a very small value, dust often makes a short circuit between an emitter 115 and a gate electrode layer 104 in a fabrication process. When one short circuit is formed between a gate electrode layer 104 and an emitter 115, the voltage can not be applied between all the remaining gate electrode layers 104 and the remaining emitters 115, so that the whole system becomes inoperable.

When the field emission cathode is initially operated, gases are locally released, thus often causing a discharge between the emitter 115 and the gate electrode layer 104 or anode electrode 116. As a result, the cathode electrode layer 101 may be sometimes destroyed due to a large current flowing therein.

Moreover, since a specific emitter which tends to emit electrons easily of the many emitters 115 emits intensively electrons, it accepts an excessive current locally. This often causes an abnormal bright spot on the screen.

The resistance layer 102 is disposed between the emitter 115 and the cathode electrode layer 101. An excessive electron emission of a specific emitter 115 causes increasing the current flowing through the emitter 115. The resistance layer 102 drops the voltage so as to suppress electron emission of the cone emitter 115, so that the emitter 115 can be prevented from emitting electrons uncontrollably. The resistance layer 102 can prevent the current from concentrating to a specific emitter 115, thus leading to the improved yield of FEDs in the manufacture and the stable operation of FEDs.

However, even when the field emission cathode has a resistance layer disposed between the cathode electrode and the emitter, as shown in FIG. 14, it is difficult to equalize the number of electrons emitted from a great number of emitters. A short circuit between a gate electrode and an emitter often causes a defect in the corresponding line.

In an emitter array where plural emitters form the electron source corresponding to each pixel, a short circuit between an emitter and a gate electrode makes it difficult to supply a sufficient current. Hence, there is the disadvantage of decreasing the brightness at only the specific defect spot in a display.

SUMMARY OF THE INVENTION

It is the object of the invention is to provide a field emission cathode that can make uniform the amount of electrons emitted from each emitter, so that any line defect does not occur even when a gate electrode is electrically short-circuited with an emitter.

In order to accomplish the above-mentioned object, a field emission cathode comprises emitters with acute tips; gate electrodes each surrounding the acute tip of each emitter; channel forming electrodes each formed over a cathode substrate; each of the emitters being formed of a metal or metallic compound deposited or processed and formed on one end of each of the channel forming electrodes; cathode electrodes each formed at the other end of each of the channel forming electrodes; and at least one current control electrode disposed between the emitters and each of the cathode electrodes to control a current flowing through each of the channel forming electrodes.

In the field emission cathode, an insulating layer is formed between each of the current control electrodes and each of the channel forming electrodes. Each of the channel forming electrodes is formed of a semiconductor thin film.

Moreover, according to the first aspect of the present invention, a field emission cathode comprises a laminated cathode substrate on which a current control electrode, a first insulating layer, a cathode electrode, a channel forming electrode, a second insulating layer, and a gate electrode are sequentially laminated, the laminated cathode substrate having openings penetrating the gate electrode and the second insulating layer; emitters each formed on the channel forming electrode exposed as the bottom surface in each of the openings; and a channel formed in a portion of the channel forming electrode confronting the current control electrode via the first insulating layer; wherein a channel current flowing from the cathode electrode to the emitters via the channel forming electrode is controlled by adjusting a voltage applied to the current control electrode.

A plurality of stripe cathode electrodes and a plurality of stripe current control electrodes are arranged in a matrix pattern. An emitter array is formed of plural emitters at an intersection of each cathode electrode and each current control electrode. The emitter array corresponds to a pixel.

In the first aspect, anode electrodes on which a fluorescent substance are formed on the anode substrate. The anode substrate is coated is disposed so as to confront the cathode substrate. The tone of an image displayed on the anode substrate can be controlled by applying an analog or digital image signal to each of said current control electrodes.

Furthermore, according to the second aspect of the present invention, a field emission cathode comprises a laminated cathode substrate formed of a channel forming electrode, a cathode electrode, an insulating layer, and a gate electrode which are sequentially formed on a cathode substrate, the laminated cathode substrate having openings penetrating the gate electrode and the insulating layer; emitters each formed on the channel forming electrode exposed as the bottom surface in each of the openings; a channel formed in a portion of the channel forming electrode; a current control electrode confronting the channel on which the insulating layer is thinned; wherein a channel current flowing from the cathode electrode to the emitters via the channel forming electrode is controlled by adjusting a voltage applied to the current control electrode.

In the second aspect, a plurality of stripe cathode electrodes and a plurality of stripe current control electrodes are arranged in a matrix pattern. An emitter array is formed of plural emitters at an intersection of each cathode electrode and each current control electrode. The anode substrate is coated is disposed so as to confront the cathode substrate. The tone of an image displayed on the anode substrate can be controlled by applying an analog or digital image signal to each of said current control electrodes.

Moreover, according to the third aspect of the present invention, a field emission cathode comprises a laminated cathode substrate formed of a channel forming electrode, a cathode electrode, an insulating layer, and a gate electrode which are sequentially formed on a substrate, the laminated cathode substrate having openings penetrating the gate electrode and the insulating layer; emitters each formed on the channel forming electrode exposed as the bottom surface in each of the openings; and a current control electrode formed over a channel in the channel forming electrode and disposed between the emitter and the cathode electrode; wherein a Schottky barrier is formed on an interface between the current control electrode and the channel forming electrode; wherein a channel current flowing from the cathode electrode to the emitters via the channel forming electrode is controlled by adjusting a voltage applied to the current control electrode.

In the second aspect, a plurality of stripe cathode electrodes and a plurality of stripe current control electrodes are arranged in a matrix pattern. An emitter array is formed of plural emitters at an intersection of each cathode electrode and each current control electrode. The anode substrate is coated is disposed so as to confront the cathode substrate. The tone of an image displayed on the anode substrate can be controlled by applying an analog or digital image signal to each of said current control electrodes.

Furthermore, according to the fourth aspect of the present invention, a field emission cathode comprises a laminated cathode substrate formed of a current control electrode, a first insulating layer, a cathode electrode, a channel forming electrode, a second insulating layer, and a gate electrode which are sequentially formed on a cathode substrate, the laminated cathode substrate having openings penetrating the gate electrode and the second insulating layer; emitters each formed on the channel forming electrode exposed as the bottom surface in each of the openings; a channel formed in a portion of the channel forming electrode confronting the current control electrode via the first insulating layer; wherein a current flowing the channel is controlled by a voltage applied to the current control electrode so that a current flowing from the cathode electrode to the emitter formed just above the channel via the channel forming electrode is controlled.

Moreover, according to the fifth aspect of the present invention, a field emission cathode comprises a laminated cathode substrate formed of a current control electrode, a first insulating layer, a cathode electrode, a channel forming electrode, a second insulating layer, and a gate electrode which are sequentially formed on a cathode substrate, the laminated cathode substrate having openings penetrating the gate electrode and the second insulating layer; emitters each formed on the channel forming electrode exposed as the bottom surface in each of the openings; the channel forming electrode formed of an I (intrinsic) semiconductor layer sandwiched between ohmic layers; a channel formed in a portion of the channel forming electrode confronting the current control electrode via the first insulating layer; wherein a current flowing the channel is controlled by a voltage applied to the current control electrode so that a current flowing from the cathode electrode to the emitter formed just above the channel via the channel forming electrode is controlled.

In the fourth and fifth aspects, a plurality of stripe cathode electrodes and a plurality of stripe current control electrodes are arranged in a matrix pattern. An emitter array is formed of plural emitters at an intersection of each cathode electrode and each current control electrode. The anode substrate is coated is disposed so as to confront the cathode substrate. The tone of an image displayed on the anode substrate can be controlled by applying an analog or digital image signal to each of said current control electrodes.

Still furthermore, according to the sixth aspect of the present invention, a field emission cathode comprises a source formed of an N- or P-type semiconductor region in a surface of a P- or N-type semiconductor substrate, and a drain formed of a N- or P-type semiconductor region in a surface of the P- or N-type semiconductor substrate; an emitter with an acute tip, formed on the drain; an insulating layer formed on a surface of the semiconductor substrate, except at least the drain and the source; a gate electrode formed on the insulating layer so as to surround the tip of the emitter; a channel gate electrode formed on the insulating layer between the drain and the source; and a source electrode formed on the source; wherein an emission current of the emitter is modulation-controlled by a signal voltage applied to a control electrode while an analog or digital image signal supplied is supplied to the channel gate electrode.

As described above, the field emission cathode of the present invention can control the emitter current according to the voltage applied to the current control electrode. Thus, the emitter current for each of a large number of emitters can be controlled evenly. Hence, the field emission cathode embodied to a display device can uniform the brightness of each pixel, thus enabling a brightness adjustment.

Moreover, when a gate electrode is short-circuited with an emitter, an excessive current density destroys the channel. The emitter short-circuited with the gate electrode can be separated from the cathode electrode, so that the occurrence of a line defect can be prevented.

By applying a low voltage of 5 to 15 V to the current control electrode, the emitter current can be controlled and the emission of the emitter is cut off. A matrix pattern of stripe cathode electrodes and the current control electrodes allows the field emission cathodes to be line-scanned (or scan driven).

Moreover, the tone of an image, which is displayed on the anode substrate confronting the cathode electrode, can be controlled by inputting analog or digital image signals to the current control emitter or channel gate electrode.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The embodiments according to the present invention will now be described below with reference to the attached drawings.

Figure 1:
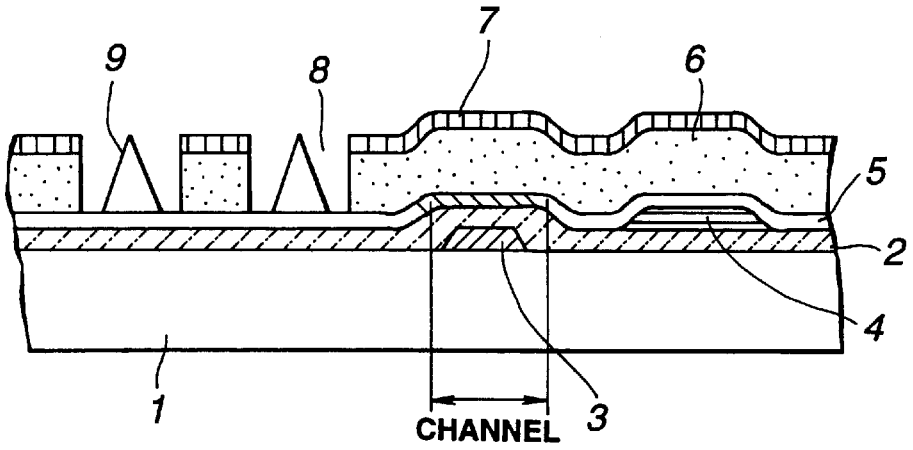
FIG. 1 is a cross-sectional view showing the configuration of a field emission cathode according to a first embodiment of the present invention.
Figure 2:
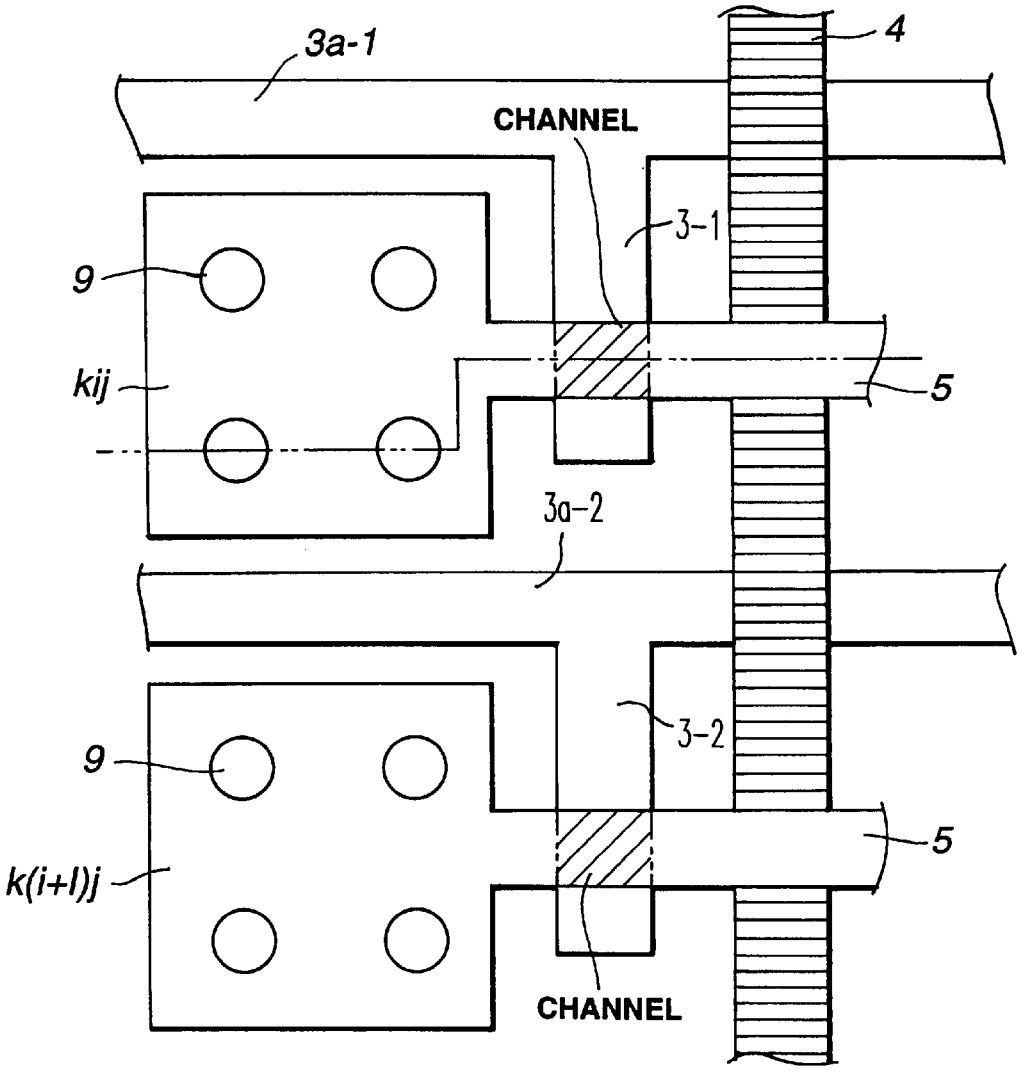
FIG. 2 is a plan view showing the configuration of a field emission cathode according to a first embodiment of the present invention.

FIG. 1 is a cross-sectional view illustrating the configuration of a field emission cathode according to the first embodiment of the present invention. FIG. 2 is a plan view of the field emission cathode shown in FIG. 1. FIG. 2 shows only the arrangement of current control electrodes 3, cathode electrodes 4, and channel forming electrodes 5.

In the field emission cathode shown in FIG. 1, a current control electrode 3 is formed on the cathode substrate 1 of glass by vapor depositing and patterning, for example, a film of niobium. A first insulating film 2 of silicon dioxide or silicon nitride is formed on the intermediate structure. A cathode electrode 4 is patterned on the first insulating film 2. Meanwhile, a channel forming electrode 5 is formed of a film of amorphous silicon (a-Si) or polysilicon having a thickness of less than about 5 $\mu$m. The channel forming electrode 5 is electrically connected to the cathode electrode 4 so as to cross the current control electrode 3 via the first insulating layer 2.

A second insulating layer 6 of silicon dioxide is formed on the channel forming electrode 5. A gate electrode 7 is formed on the second insulating layer 6. Plural openings 8 are in the second insulating layer 6 and the gate electrode 7. Emitters 9, each which is made of a high-melting point metal, carbon, nitride, silicon compound, or carbide, are formed on the bottom of the opening 8 or the channel forming electrode 5.

A channel film of a full depletion type is formed at only the portion where the channel forming electrode 5 crosses the current control electrode 3. The remaining portions are formed of, for example, a-Si with a high conductivity. The channel is normally in a non-conductive state. When a predetermined positive voltage is applied to the current control electrode 3, an N-channel is created due to negative charges induced, thus establishing a conductive state.

FIG. 2 is a plan view illustrating the field emission cathode with the above-mentioned structure. FIG. 1 is a cross-sectional view illustrating the field emission cathode taken along the phantom line shown in FIG. 2.

As shown in FIG. 2, stripe current control electrodes 3 and stripe cathode electrodes 4 are arranged in a matrix pattern. For example, the current control electrodes 3 form lines while the cathode electrodes 4 form columns. The current control electrodes 3 are formed of first current control electrodes 3-1, 3-2, . . . crossing the channels and the second current control electrodes 3a-1, 3a-2, . . . acting as lines. One end of each channel forming electrode 5 is directly disposed on the stripe cathode 4 so as to connect electrically with the stripe cathode 4. Channels are respectively formed on the electrodes 5 extending from the cross points and at the points where the first current control electrodes 3-1, 3-2, . . . cross.

The channel forming electrode 5 extending from the channel has a broader width. Plural cone emitters 9 formed on the channel forming electrode 5 correspond to one pixel in a display device. That is, each of Kij and K(i+1)j corresponds to a pixel. In FIG. 2, the first insulating layer 2, the second insulating layer 6, and the gate electrode 7 are not shown.

In the field emission cathode having the above-mentioned structure, when a threshold voltage or more is applied to the current control electrode 3, an N channel is formed in the channel in a normally off state to establish a conduction state. Thus, a current flows from the cathode electrode 4 to the emitters 9, so that the emitters 9 emit electrons. The threshold voltage is, for example, a low voltage of 5 to 15 V. The number of mobile electrons depends on the channel length. The longer the channel length becomes, the lower the threshold voltage becomes.

Figure 9:
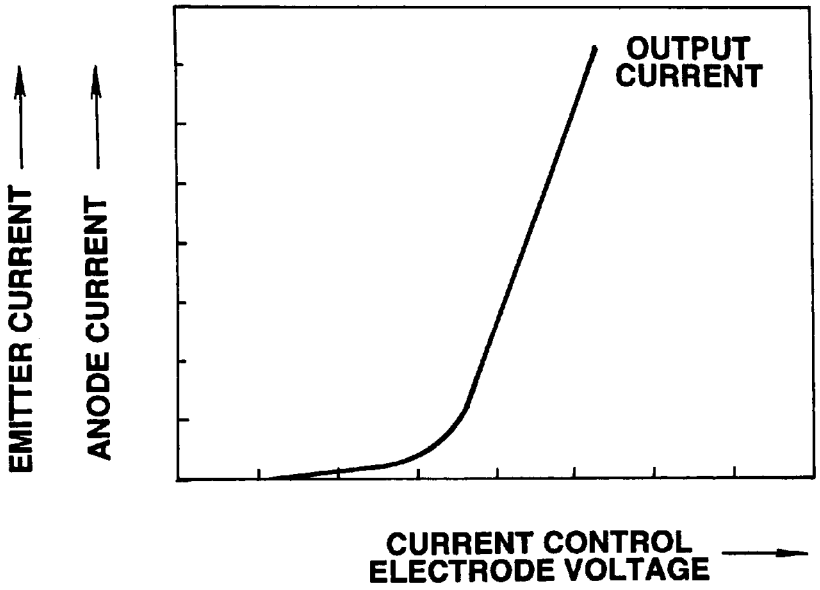
FIG. 9 shows a relationship between current control electrode voltage and emitter current for output current and a relationship between current control electrode voltage and anode current for output current, in a field emission cathode according the present invention.

The emitter current, as shown in FIG. 9, increases with the square of the voltage applied to the current control electrode 3. The number of electrons emitted from each emitter 9 can be adjusted by controlling the voltage applied to the current control electrode 3. Hence, as shown in FIG. 9, in the cathode applied to a display device, the anode current, that is, brightness can be adjusted by controlling the applied voltage to the current control electrode 3.

When the voltage applied to the current control electrode 3 is set to less than the threshold voltage, the channel becomes a non-conduction state, so that the current supplied from the cathode electrode 4 to the emitter 9 is cut off. Hence, the current control electrode 3 and the cathode electrode 4 can be used for a dynamic scan-drive operation, without scan-driving the gate electrode 7. Consequently, where the field emission cathode is applied to a display device, an image can be displayed by applying an image signal to the cathode electrode every line and sequentially scan-driving the current control electrode 3.

In this case, since a fixed voltage at which electrons can be emitted from the emitter 9 is merely applied to the gate electrode 7, it is not needed to scan-drive the gate electrode 7 to which a higher voltage than that to the current control electrode 3 is applied. As a result, the configuration of the drive circuit can be simplified. Moreover, since the gate electrode 7 is not scanned, it can be formed as a solid electrode not patterned. However, it is more preferable to use a patterned gate electrode in consideration of the occurrence of a parasitic capacitance.

The channel portion of the channel forming electrode 5 is formed of a full-depletion-type ultrathin film having a thickness of 0.1 to 0.2 $\mu$m. In this case, when the emitter 9 runs away out of control, the channel can be destroyed due to the excessive current density thereof. Hence, because the destroyed channel does not flow any current, the line defect caused by a short circuit of the emitter 9 and the gate electrode 7 can be prevented.

In the above explanation, plural emitters 9 are formed as one pixel. However, a single emitter 9 may be formed so as to act as one pixel.

Figure 3:
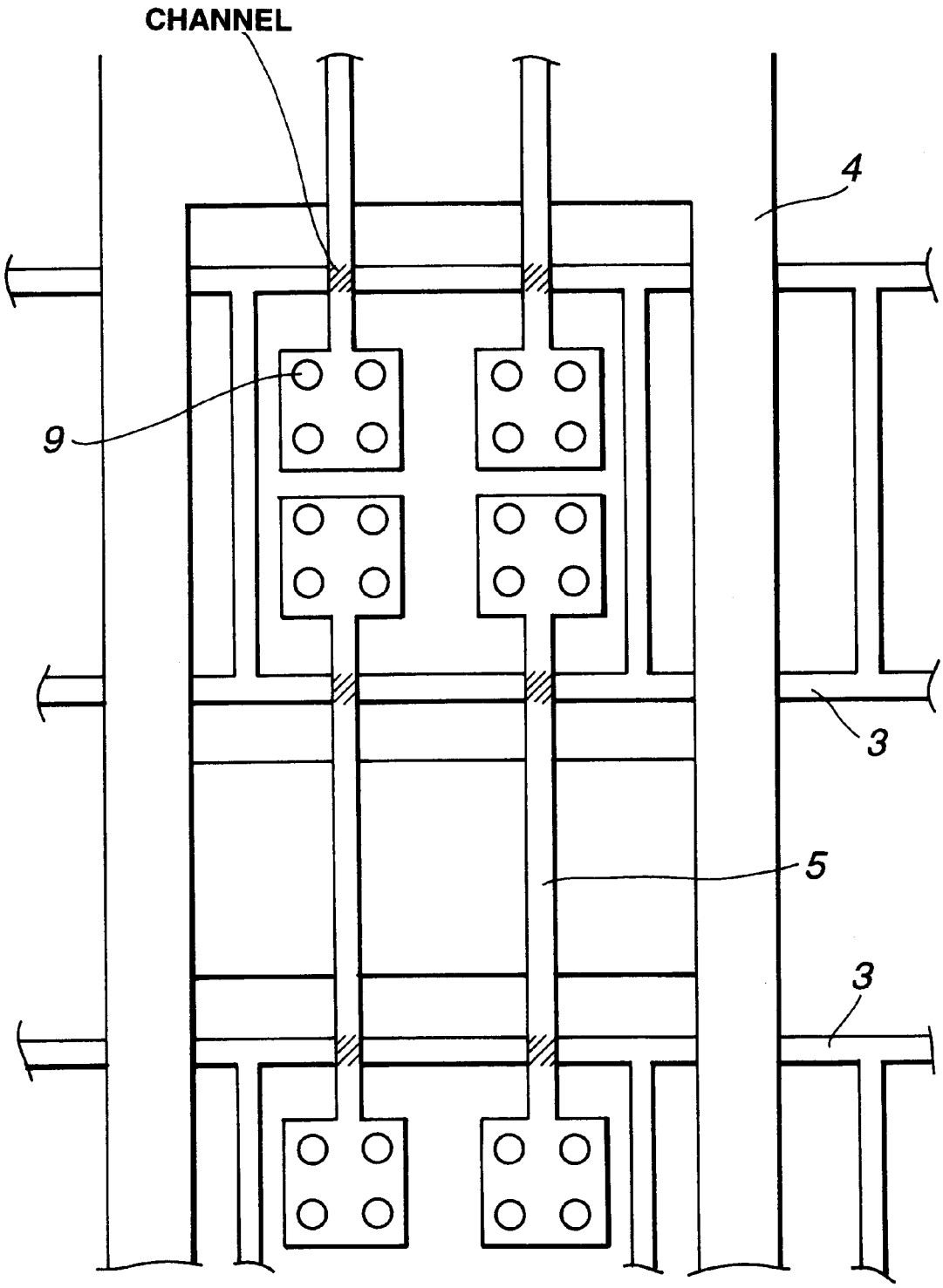
FIG. 3 is a plan view showing the configuration of a modified field emission cathode according a first embodiment of the present invention.

The configuration of a modified field emission cathode according to the first embodiment of the present invention is shown in FIG. 3. FIG. 3 is a plan view illustrating a field emission cathode corresponding to that of FIG. 2. FIG. 3 merely shows a layout of current control electrodes 3, cathode electrodes 4, and channel forming electrodes 5.

Referring to FIG. 3, plural stripe cathodes 4 and stripe plural current control electrodes 3 are arranged in a matrix pattern. The electrodes 3 and 4 are patterned at the intersection where the current control electrode 3 crosses the cathode electrode 4. The channel forming electrode 5, on which plural emitters 9 are formed in the intersection, is formed in the pattern shown in FIG. 3. That is, plural channel forming electrodes 5, each on which the emitters 9 are formed, are formed in an island pattern respectively.

The field emission cathode having the above-mentioned structure has the same function as that of the first embodiment.

Figure 4:
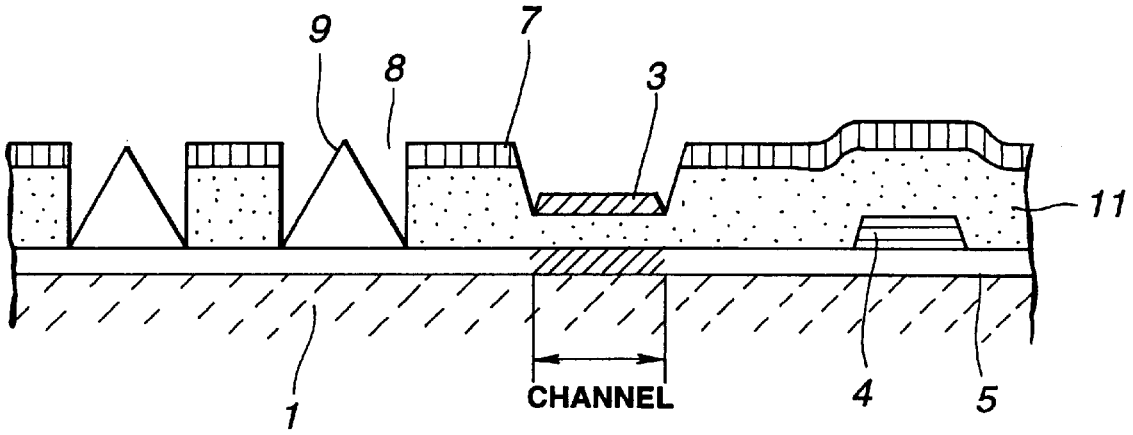
FIG. 4 is a cross-sectional view showing the configuration of a field emission cathode according a second embodiment of the present invention.

The configuration of the field emission cathode according to the second embodiment of the present invention will be shown in FIG. 4.

In the field emission cathode shown in FIG. 4, a channel forming electrode 5 formed of an amorphous silicon (a-Si) or polysilicon having a thickness of less than 0.5 $\mu$m is formed on a portion of the cathode substrate 1 of glass. A cathode electrode 4 is patterned on the channel forming electrode 5. An insulating layer 11 of a silicon dioxide or silicon nitride is formed on the surface of the channel forming electrode 5. A gate electrode 7 is formed on the surface of the insulating layer 11. Plural openings are formed so as to penetrate the insulating layer 11 and the gate electrode 7. A cone emitter 9 of a high-melting point metal, carbon, nitride, silicon compound, or carbide is formed on the bottom of each opening 8, that is on the channel forming electrode 5.

Moreover, a channel of a full depletion-type thin film is formed in a portion of the channel forming electrode 5. The current control electrode 5 is formed on the insulating layer 11 so as to intersect over the channel portion and the insulating layer 11. The remaining portion of the channel forming electrode 5 except the channel portion is formed of a material with a high conductivity, for example, a-Si. This channel is normally in a non-conductive state. When a predetermined positive voltage is applied to the current control electrode 3, electric charges are induced in the channel, thus establishing a conduction state.

In the field emission cathode having the above-mentioned structure, when a threshold voltage is applied to the current control electrode 3, the width of the depletion layer in the channel which is normally in a non-conduction state is narrowed, so that a conduction state is established. Thus, since current is supplied from the cathode electrode 4 to the emitter 9, the emitter 9 emits electrons. The threshold voltage is, for example, a low voltage of 5 to 15 V. The number of mobile electrons depends on the channel length. The longer the channel length becomes, the lower the threshold voltage becomes.

The channel conductivity can be controlled by adjusting the voltage applied to the current control electrode 3, so that the number of electrons emitted from each cathode 9 can be controlled. The emitter current, as shown in FIG. 9, varies with the square of voltage applied to the current control electrode 3.

The current forming electrodes 3 and the cathode electrodes 4 are respectively formed in a stripe pattern and are arranged in a matrix pattern. Where the field emission cathode is applied to a display device, an image can be displayed by applying an image signal to the cathode electrodes 4 every line and sequentially scan-driving the current control electrodes 3.

In this case, the emitter 9 can emit electrons merely by applying a fixed voltage to the gate electrode 7. Since it is not required to scan-drive the gate electrode 7 to which a higher voltage than that to the current control electrode 3 is applied, the drive circuit can be simplified in configuration.

Where the field emission cathode is applied to a display device, the brightness can be adjusted by varying the anode current with respect to the voltage applied to the current control electrode 3.

Moreover, the channel portion of the channel forming electrode 5 is formed of a full depletion-type ultrathin film having a thickness of 0.1 to 0.2 $\mu$m. Thus, when the emitter 9 runs away out of control, the current density of the channel increases so that the channel is destroyed. Since the defective emitter 9 can be separated from the cathode electrode 4, occurrence of the line defect due to a short circuit between the emitter 9 and the gate electrode 7 can be prevented.

Plural emitters 9 may be formed so as to correspond to one pixel. One emitter 9 may be formed so as to correspond to one pixel.

Figure 5:
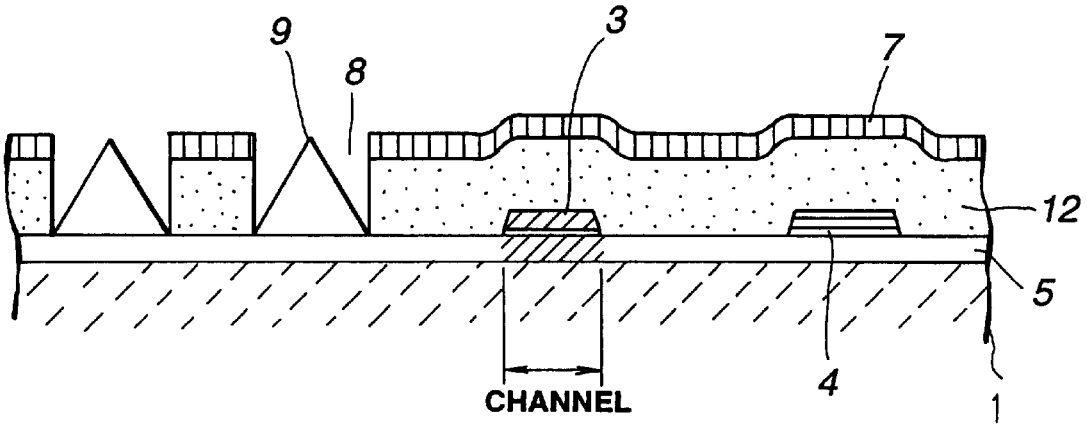
FIG. 5 is a cross-sectional view showing the configuration of a field emission cathode according a third embodiment of the present invention.

FIG. 5 is a cross-sectional view showing a field emission cathode according to the third embodiment according to the present invention.

In the field emission cathode shown in FIG. 5, a channel forming electrode 5 of amorphous silicon (a-Si) or polysilicon having a thickness of less than about 0.5 μm is formed on the cathode substrate 1 of a glass. A channel is formed in a portion of the channel forming electrode 5. A patterned current control electrode 3 is formed on the channel forming electrode 5. An insulating layer 12 of silicon dioxide or silicon nitride is formed on the current control electrode 3 and the cathode electrode 4. In order to form a Schottky barrier on the interface between the channel forming electrode 5 and the current control electrode 3, the doped amount of an impurity in the channel forming electrode 5 and a metal material of the current control electrode 3 are selected.

A gate electrode 7 is formed on the insulating layer 12. Plural openings 8 are formed so as to penetrate the insulating layer 12 and the gate electrode 7. Cone emitters 9 each which is of a high melting point metal, carbon, nitride, silicon compound, or carbide are formed on the bottom of the opening 8 or on the channel forming electrode 7.

In the channel forming electrode 5, the portion underneath the current control electrode 3 being a full depletion-type thin film is formed as a channel. The remaining portion of the channel forming electrode 5 except the channel is formed of, for example, a-Si having a high conductivity. This channel is normally in a non-conduction state. When a predetermined positive voltage is applied to the current control electrode 3, a conduction state is established.

In the field emission cathode having the above-mentioned structure, when a threshold voltage or more is applied to the current control electrode 3, the width of the depletion layer of a channel in a non-conduction state is narrowed, so that a conduction state is established. This operation allows current to flow from the cathode electrode 4 to the emitter 9, so that the emitter 9 emits electrons. The threshold voltage is a low voltage of 5 to 15 V. The number of mobile electrons is controlled according to the channel length. The longer the channel length becomes, the lower the conductivity becomes.

The channel conductivity can be controlled by adjusting the voltage applied to the current control electrode 3, so that the number of electrons emitted from each emitter 9 can be controlled. In this case, the emitter current, as shown in FIG. 9, varies with the square of the voltage applied to the current control electrode 3.

Moreover, in order to apply to a display device, the current control electrodes 3 and the cathode electrodes 4 are respectively formed in a stripe pattern and are arranged in a matrix pattern. An image can be displayed by applying an image signal to the cathode electrodes 4 every line and sequentially scan-driving the current control electrodes 3.

In this case, a fixed voltage at which the emitter 9 can emit electrons is applied to the gate electrode 7. Since it is not needed to scan-drive the gate electrode 7 to which a higher voltage than that to the current control electrode 3 is applied, the configuration of the drive circuit can be simplified.

In a display device employing the field emitter cathode, brightness can be adjusted by controlling the anode current which varies to the voltage applied to the current control electrode 3 as shown in FIG. 9.

The channel portion of the channel forming electrode 5 is formed of a full-depletion-type ultrathin film having a thickness of 0.1 to 0.2 μm. Thus, when the emitter 9 runs away out of control, the channel can be destroyed due to the excessive current density of the channel. This enables the uncontrollable emitter 9 to be separated from the cathode electrode 9. It can be prevented that a line defect occurs due to a short circuit between the emitter 9 and the gate electrode 7.

Plural emitters 9 may be formed corresponding to one pixel or a single emitter 9 may be formed corresponding to one pixel.

In the field emission cathodes according to the first to the third embodiments, the method of fabricating the channel forming electrode 3 in which a channel is partially formed will be described below.

According to the first fabrication method, a channel forming electrode is first formed with a $P^+$ amorphous silicon (a-Si). Then, only the channel forming portion (a-Si) is doped with N-type impurities such as phosphorus to convert into a P-type amorphous silicon region. Thus, a channel forming electrode partially having a full-depletion-type channel can be fabricated.

According to the second fabrication method, a channel forming electrode is first formed with a P-type amorphous silicon (a-Si). Then, the remaining portion (a-Si), except the channel portion to be formed, is doped with P-type impurities such as boron to convert into a $P^+$-type amorphous silicon region. Thus, a channel forming electrode partially having a full-depletion-type channel can be fabricated.

Since the P-type amorphous silicon has a memory effect, it can be used for the scan-drive operation.

Figure 6:
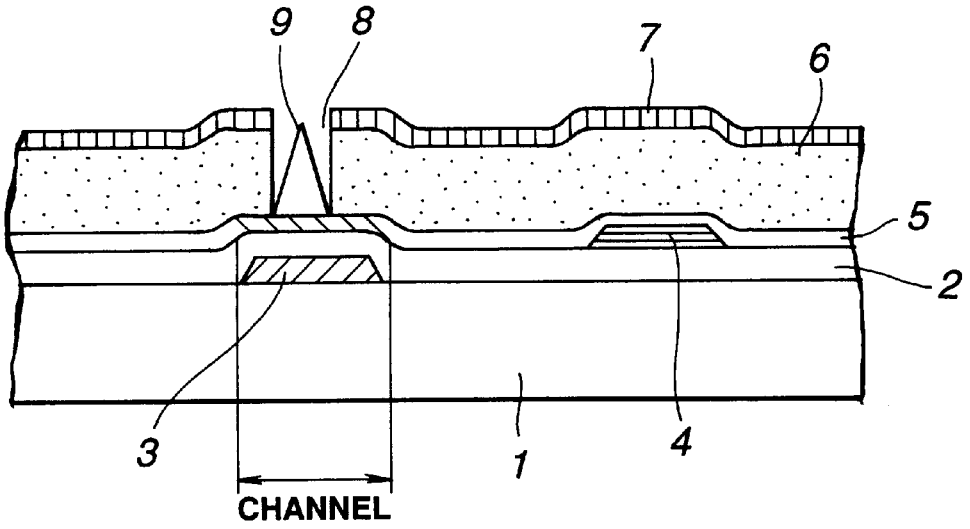
FIG. 6 is a cross-sectional view showing the configuration of a field emission cathode according a fourth embodiment of the present invention.

FIG. 6 is a cross-sectional view illustrating the field emission cathode according to the fourth embodiment of the present invention.

The field emission cathode according to the fourth embodiment shown in FIG. 6 differs from that according to the first embodiment shown FIG. 1. That is, the channel is formed beneath the emitter 9. The current control electrode 3 is formed beneath the emitter 9 via the channel and the first insulating layer 2.

In this structure, according to the first fabrication method, a channel can be formed in the channel forming electrode 5 by doping N-type impurities via the opening formed in the gate electrode 7 and the second insulating layer 6.

The field emission cathode of the fourth embodiment resembles that of the first embodiment in its operation and the above-mentioned contents. Hence, the duplicate description will be omitted here.

Figure 7:
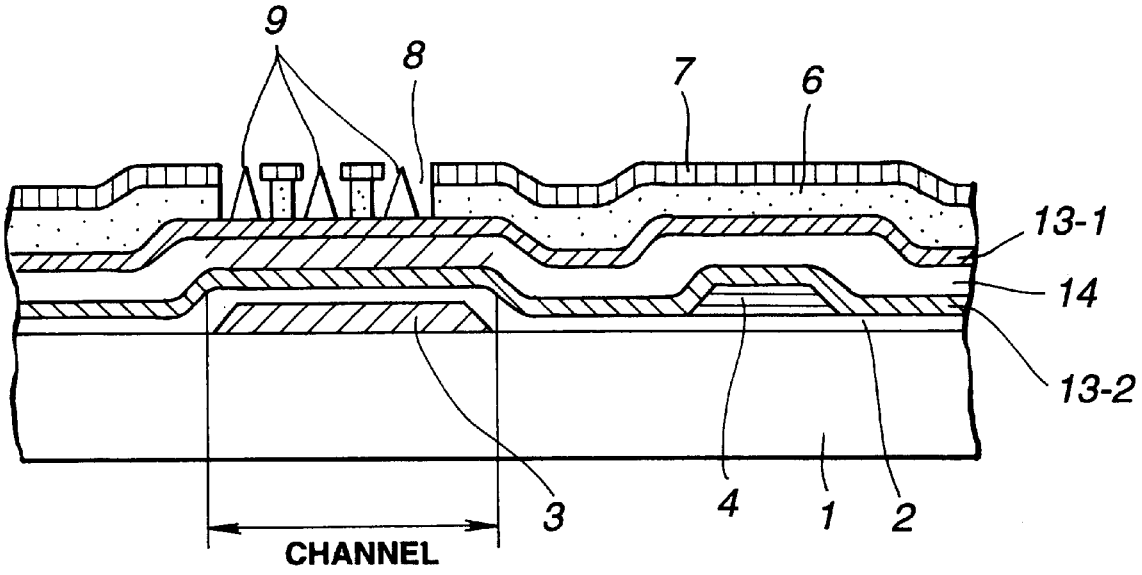
FIG. 7 is a cross-sectional view showing the configuration of a field emission cathode according a fifth embodiment of the present invention.
Figure 8:
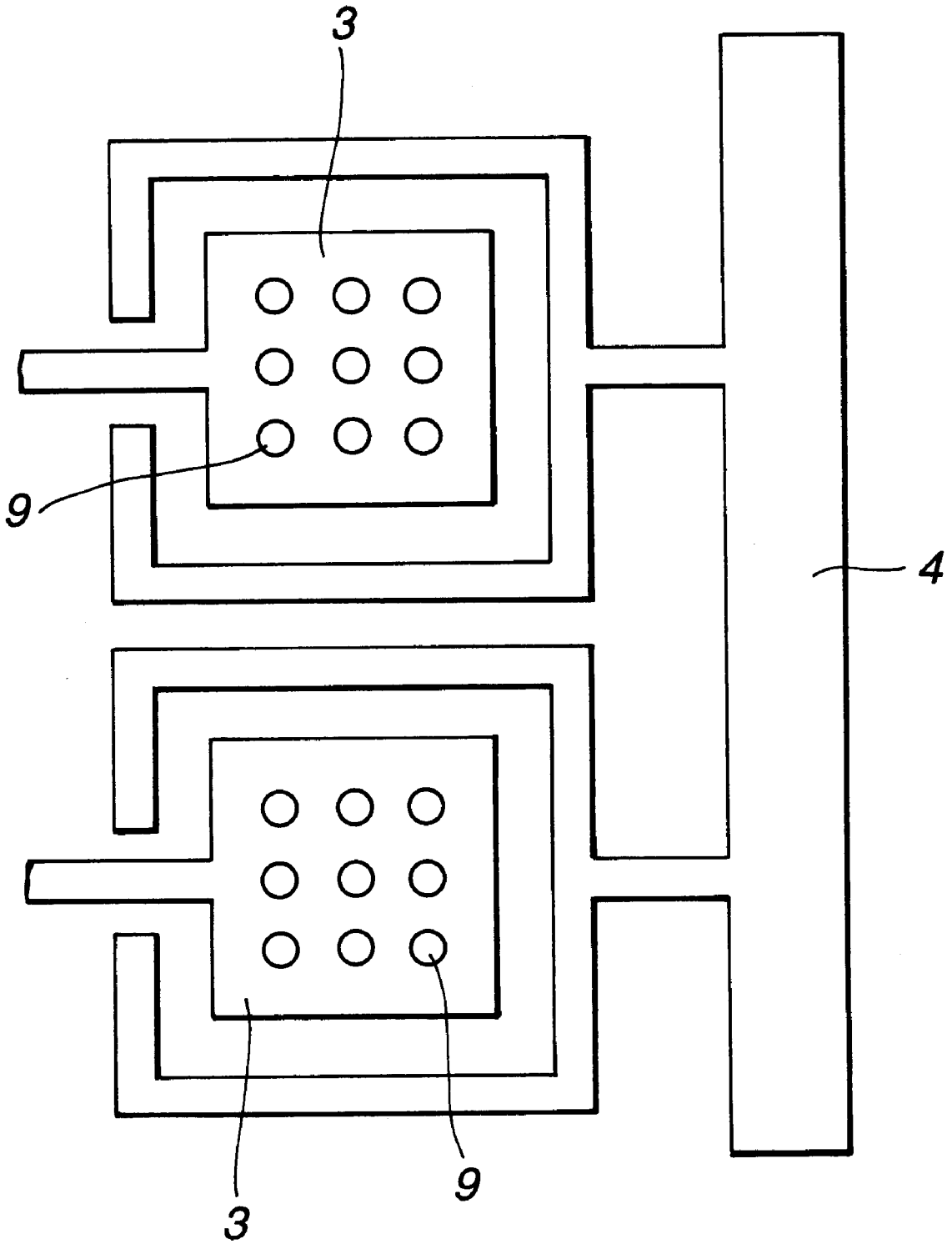
FIG. 8 is a plan view showing the configuration of a field emission cathode according a fifth embodiment of the present invention.

FIG. 7 is a cross-sectional view illustrating the field emission cathode according to the fifth embodiment of the present invention. FIG. 8 is a plan view illustrating the field emission cathode of FIG. 7. FIG. 8 shows only the layout of the current control electrode 3, the cathode electrode 4, and the ohmic contact layers 13-1 and 13-2.

Referring to FIGS. 7 and 8, the channel, unlike in the first embodiment of FIG. 1, is formed underneath the emitter 9 while the current control electrode 3 is formed underneath the emitter 9 via the channel and the first insulating layer 2. The channel forming electrode 14 is formed of an I (Intrinsic) a-Si layer sandwiched between the ohmic contact layers 13-1 and 13-2. The I layer has a specific resistance of $10^7$ to $10^8$ Ω-cm. Each of the I layers 13-1 and 13-2 has a specific resistance of $10^3$ to $10^5$ Ω-cm. This structure allows the resistance of the area forming the emitter 9 to be equalized. Each of the ohmic contact layers 13-1 and 13-2 are formed by doping N-type impurities into the surface of the I (Intrinsic) a-Si layer 14.

In the field emission cathode with the above-mentioned structure according to the fifth embodiment, the channel is normally in a non-conduction state. The ohmic contact layer 13-2 acts as a resistance layer electrically connected to the cathode electrode 4. In the channel region, when a threshold voltage is applied to the current control electrode 3, current flows from the ohmic contact layer 13-2 to the ohmic contact layer 13-1 via the I layer 14, so that the emitter 9 emits electrons. At this time, the current supplied to each emitter 9 is equalized by the resistance action of the ohmic contact layers 13-1 and 13-2. The threshold voltage is, for example, a low voltage of 5 to 15 V. The number of mobile electrons is controlled by the channel length. The longer the channel length becomes, the lower the threshold voltage becomes.

The emitter current, as shown in FIG. 9, varies with the square of the voltage applied to the current control electrode 3. The number of electrons emitted from each emitter 9 can be adjusted by controlling the voltage applied to the current control electrode 3. Hence, in the field emission cathode applied to a display device, the anode current, that is, brightness, as shown in FIG. 9, can be controlled by adjusting the voltage applied to the current control electrode 3.

As shown in FIG. 8, each current control electrode 3 and each cathode electrode 4 are formed in a stripe pattern. An X-Y matrix is formed with the emitter control electrodes 3 and the cathode electrodes 4. In the field emission cathode applied to a display device, an image can be displayed by applying an image signal to the cathode electrodes 4 every line and sequentially scan-driving the current control electrodes 3.

In this case, a fixed voltage is merely applied to the gate electrode 7 (FIG. 7) to emit electrons from the emitter 9. Since it is not needed to scan-drive the gate electrode 7 (FIG. 7) to which a higher voltage than to the current control electrode 3 is applied, the configuration of the drive circuit can be simplified.

Furthermore, the channel portion of the channel forming electrode 14 is formed of a full-depletion-type ultrathin film of 0.1 to 0.2 $\mu$m. Thus, when the emitter 9 runs away out of control, the channel can be destroyed due to the increased currant density thereof. As a result, a line defect caused by a short circuit between the emitter 9 and the gate electrode 7 (FIG. 7) can be prevented.

As described above, the field emission cathodes in the first to fifth embodiments are applicable as electron sources for display devices. A display device employing the field emission cathode according to the first embodiment as an electron source will be described below with reference to FIG. 10.

Figure 10:
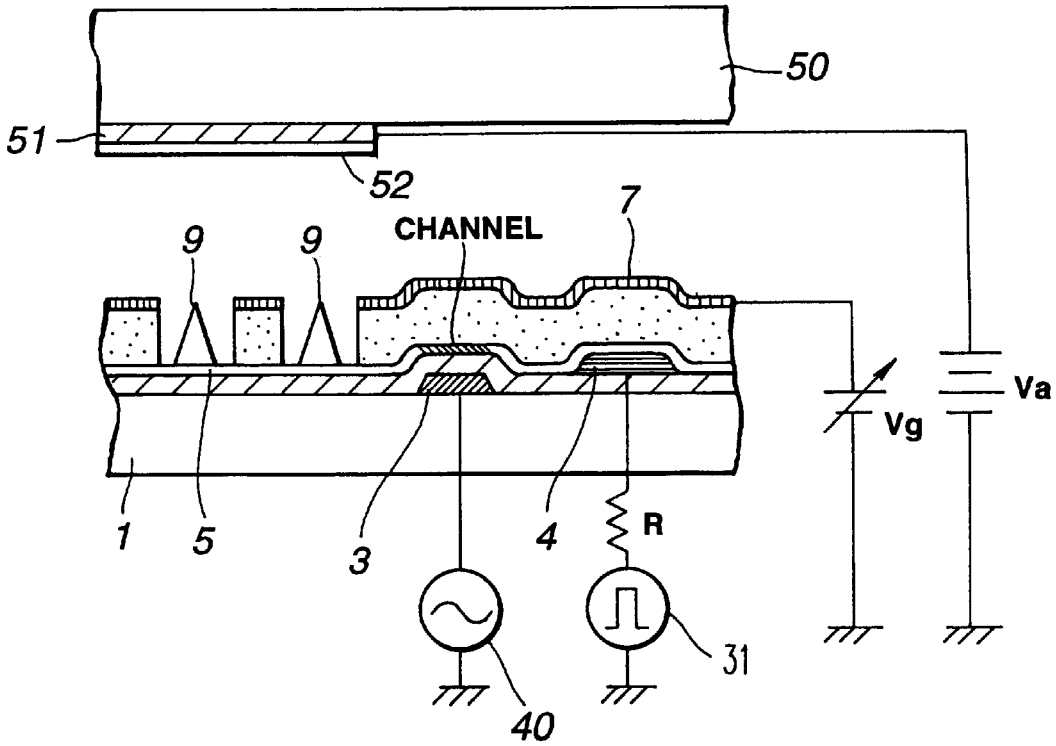
FIG. 10 is a diagram showing another configuration of a display device employing the field emission cathode according to the first embodiment of the present invention.

Referring to FIG. 10, this structure differs from the configuration of the field emission cathode according to the first embodiment shown in FIG. 1 in that the cathode substrate 1 is spaced from the insulating anode substrate 50 a predetermined distance apart so as to confront each other. The anode substrate 50 is formed, for example, of a glass. A conductive thin film for forming an anode electrode 51 is formed on the inner surface of the anode substrate 50. A fluorescent substance layer 52 is coated over the surface of the anode electrode 51.

The scanning pulse generator 31 sequentially generates a chain of scan pulses to plural stripe cathode 4 via the resistor R to scan each pixel controllably. A gate voltage Vg is applied to the gate electrode 7. An anode voltage Va is applied to the anode electrode 51. When an analog video signal 40 for a desired image is output to the current control electrode 31, only the channel of the channel forming electrode 5 which is connected to the cathode 4 selected by the scan pulse from the scanning pulse generator 31 becomes conductive. Thus, the current corresponding to the level of the analog video signal 40 is supplied to the emitter 9 formed on the channel forming electrode 5. At this time, since a strong electric field occurs between the tip of the emitter 9 and the gate electrode 7, the emitter 9 emits electrons proportional to the density of the supplied current.

The field emission electrons travels in the vacuum space between the cathode substrate 1 and the anode substrate 50 and then impinge on the fluorescent substance layer 52 coated on the anode electrode 51.

Figure 11:
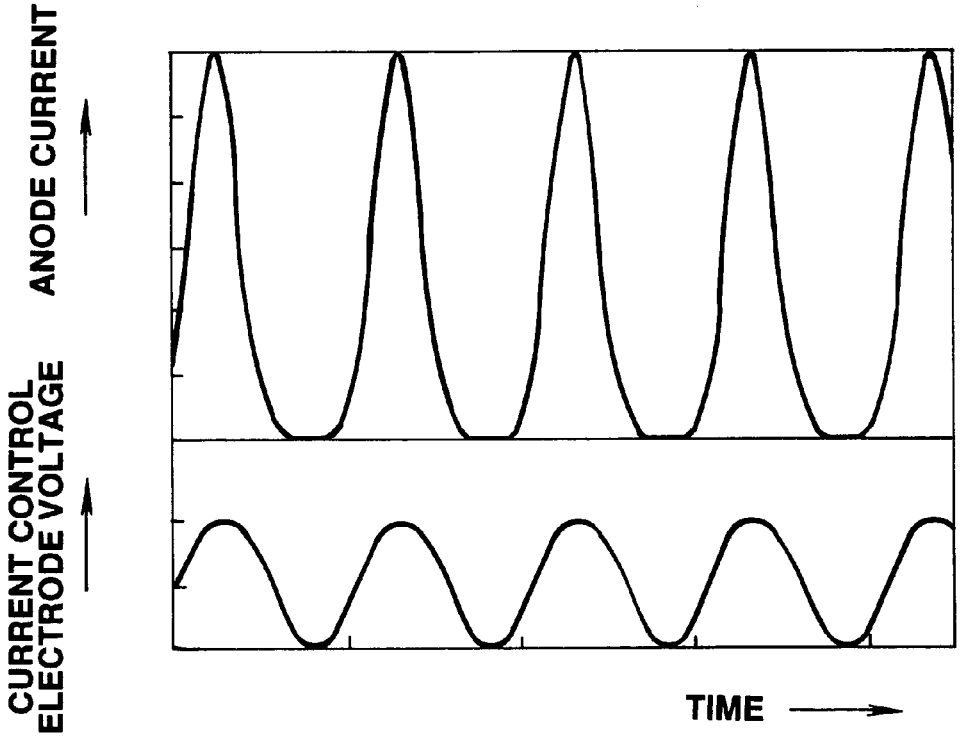
FIG. 11 shows variations in anode current to current control electrode voltages of a field emission cathode according the present invention.

In this operation, the fluorescent substance 52 glows. The luminous intensity is proportional to the anode current flowing through the anode electrode 51. For example, when the analog video signal 40 to be applied to the current control electrode 3 varies as shown with the lower portion of the FIG. 11, the anode current flowing through the anode electrode 51 varies as shown the upper portion of the FIG. 11.

That is, since the luminous intensity on the anode substrate 50 corresponds to the level of the analog video signal 40, an image tone-controlled with the video signal 40 is displayed on the anode substrate 50. In the tone control, an analog signal of less than several volts may be applied to the current control electrode 3. The brightness adjustment can be performed by controlling the level of the gate voltage Vg.

As described above, the above-mentioned configuration can easily perform a continuous tonal control with low voltages, compared with the case where a tonal control signal is applied to the gate electrode 7. For that reason, the tonal control can be executed with low power consumption and at low costs.

In order to realize tones proportional to the level of the tonal control signal, the analog or digital signal may be applied to the current control electrode 3 via the tone compensation circuit.

The drive control method in the display device shown in FIG. 10 is applicable to the field emission cathodes according to the second to fifth embodiments.

Figure 12:
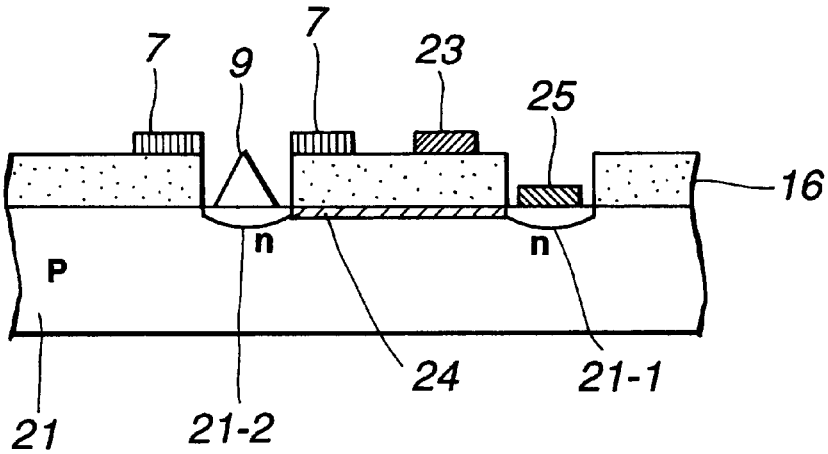
FIG. 12 is a diagram showing the configuration of a proposed field emission cathode.

The field emission cathode having the structure shown in FIG. 12 is proposed here.

In this field emission cathode, two N (or P)-type silicon regions 21-1 and 21-2, disposed a predetermined distance apart, are formed by diffusing N (or P)-type impurities into, for example, the surface of a single-crystal P (or N)-type silicon substrate 21. An insulating layer 16 is formed on the P (or N)-type silicon substrate 21 between the N (or P)-type silicon regions 21-1 and 21-2. A channel gate electrode 23 is formed on the insulating layer 16. An N-type channel 24 is formed between the N (or P)-type silicon region 21-1 and the N (or P)-type silicon region 21-2. Finally, a C-MOS field effect transistor (FET) is formed. That is, the N (or P)-type silicon region 21-2 acts as a drain; the N (or P)-type silicon region 21-1 acts as a source; and the channel gate electrode 23 acts as a gate electrode. The source electrode 25 is formed on the N (or P)-type silicon region 21-1.

An emitter 9 with an acute tip is formed on the N (or P)-type silicon region 21-2. A gate electrode 7 is formed on the insulating layer 16 so as to surround the tip of the emitter 9.

The field emission cathode with the above-mentioned structure is applicable as an electron source in a display device. The structure of the above-mentioned application will be described below with reference to FIG. 13.

Figure 13:
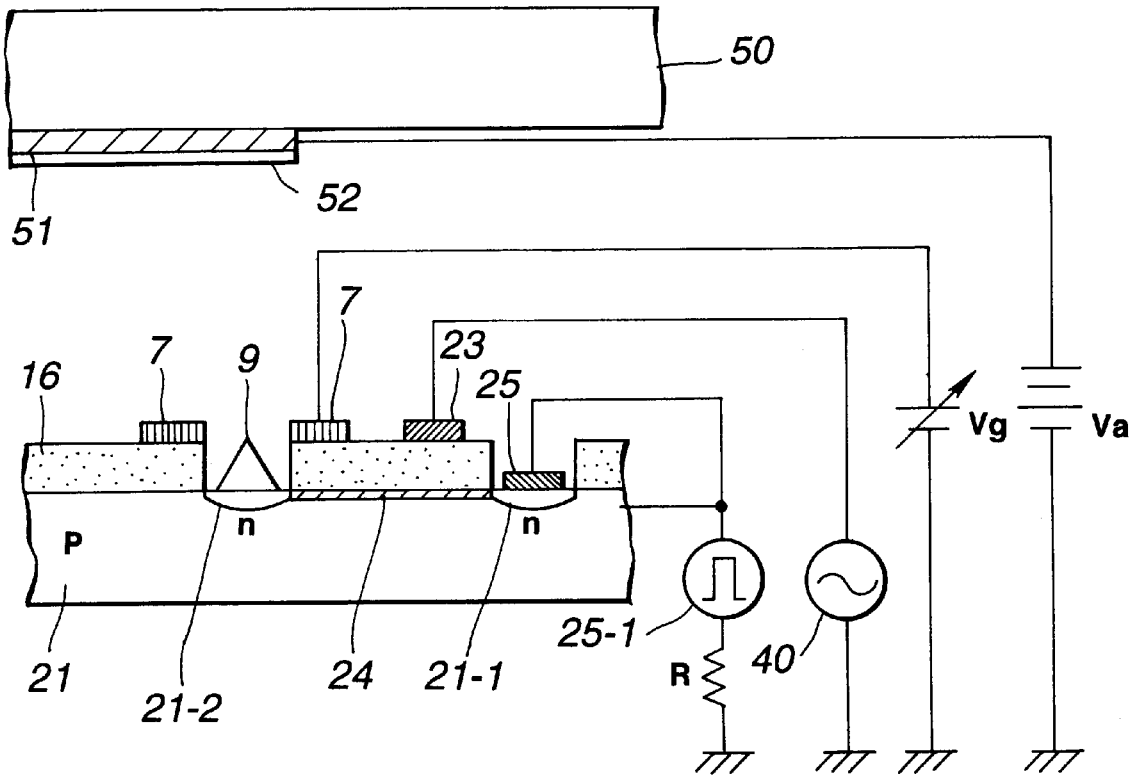
FIG. 13 is a diagram showing the configuration of a display device employing the field emission cathode shown in FIG. 11.
Figure 14:
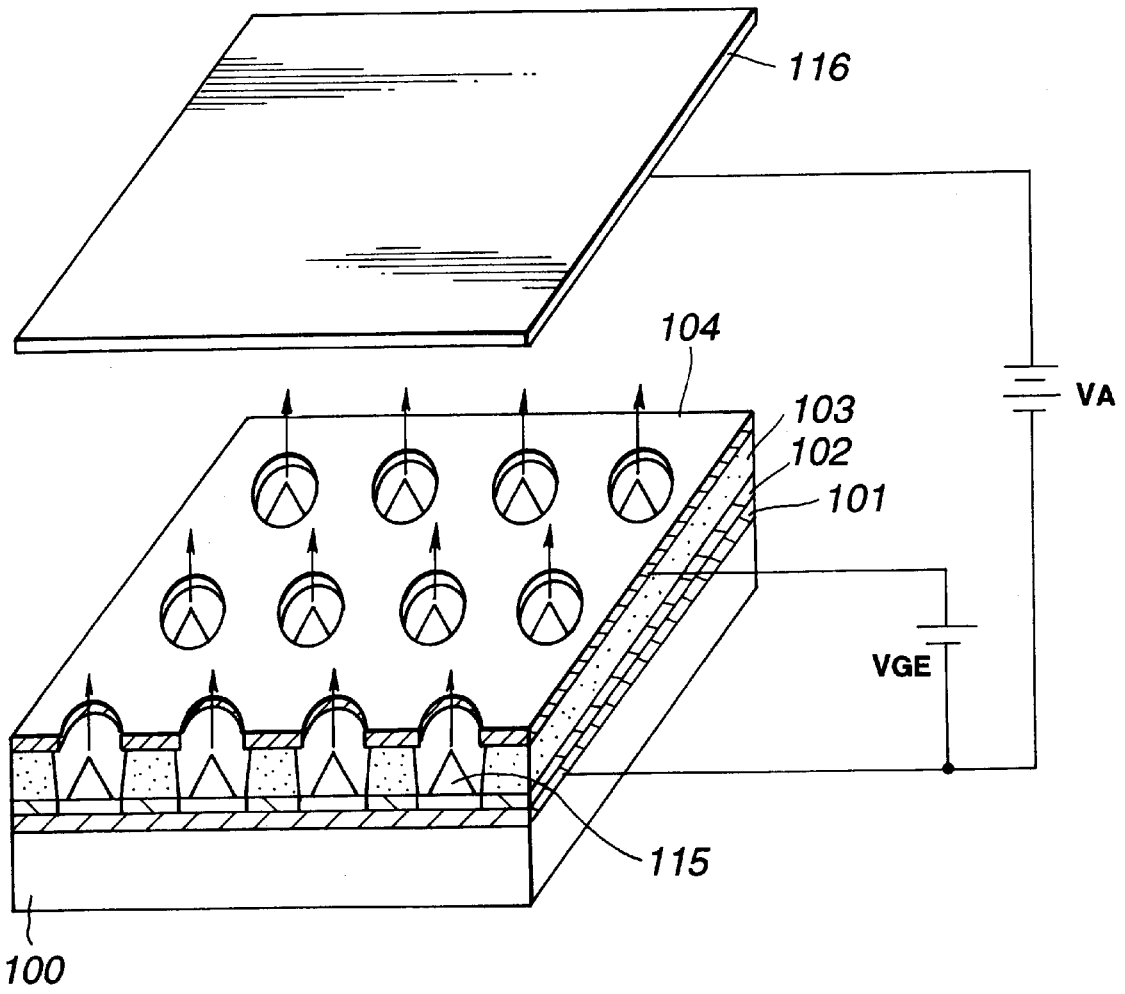
FIG.14 (PRIOR ART)
FIG. 14 is a diagram illustrating the configuration of a conventional field emission cathode.

As shown in FIG. 13, an insulating anode substrate 50 is disposed above the P (or N)-type silicon substrate 21 for the field emission cathode shown in FIG. 12 a predetermined distance apart so as confront each other. The anode substrate 50 is formed, for example, of a glass. A conductive thin film forming the anode electrode 51 is formed on the inner surface of the anode substrate 50. A fluorescent substance layer 52 is formed is coated on the surface of the anode electrode 51.

The scanning pulse generator 25-1 sequentially supplies a chain of scanning pulses to plural stripe source electrodes 25 via the resistor R to controllably scan each pixel. A gate voltage Vg is applied to the gate electrode 7. An anode voltage Va is applied to the anode electrode 51. When the analog video signal 40 is supplied to the channel gate electrode 23 to display an image, only the channel 24 disposed between the source electrode 25 and the drain 21-2 selected by the scanning pulse from the scanning pulse generator 25-1 becomes conductive. As a result, the current corresponding to the level of the analog video signal 40 flows the source electrode 25 to the drain 21-1, so that the emitter current is supplied from the source electrode 25 to the emitter 9. In this case, since a strong electric field occurs between the tip of the emitter 9 and the gate electrode 7, the emitter 9 emits electrons corresponding to the density of the supplied current under the electric field.

The emitted electrons travel in the vacuum space between the P (or N)-type silicon substrate 21 and the anode substrate 50 and impinges upon on the fluorescent substance layer 52 coated on the anode electrode 51.

In such an operation, the fluorescent substance layer 52 glows but the luminous intensity is proportional to the anode current flowing through the anode electrode 51. For example, the analog video signal 40 applied to the channel gate electrode 23 varies as shown with the lower waveforms in FIG. 11. The anode current flowing through the anode electrode 51 varies as shown with the upper waveforms in FIG. 11.

That is, since the luminous intensity on the anode substrate 50 is proportional to the level of the analog video signal 40, an image tone-controlled with the video signal 40 is displayed on the anode substrate 50. In the tone control, an analog signal of less than several ten volts may be used as the voltage applied to the channel gate electrode 23. The brightness can be adjusted by controlling the level of the gate voltage Vg.

The configuration for performing the tone control by the above-mentioned operation can easily perform continuous tonal control on a low voltage, compared with the case where a tonal control signal is applied to the gate electrode 7. Hence, the tonal control can be performed with low power consumption and at low costs.

In order to obtain the tone proportional to the level of the tone control signal, an analog or digital signal may be applied to the channel gate electrode 23 via the tone compensation circuit.

As described above, according to the field emission cathode of the present invention, the emitter current can be controlled according to the voltage applied to the current control electrode. Therefore emitter currents of plural emitters can be evenly controlled respectively. In the display device employing the field emission cathodes, the brightness of each pixel can be equalized and adjusted.

Moreover, when a gate electrode is short-circuited with an emitter, the current density of the channel increases so that the channel is destroyed. Consequently, the occurrence of a line defect can be prevented by separating the emitter short circuited with the gate electrode from the cathode electrode.

The emitter current can be controlled by applying a low voltage of 5 to 15 volts to the current control electrode. Moreover, the emission of the emitter can be cut off. The field emission cathodes can be subjected to a scan-drive operation such as a line scanning operation by forming a matrix of the stripe cathode electrodes and the cathode electrodes.

Moreover, the tone of an image to be displayed on the anode substrate confronting the cathode substrate can be linearly controlled on a low voltage by supplying an analog image signal of less than several ten volts to the current control electrode or channel gate. As a result, the tonal control can be realized with low power consumption and at low costs.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission cathode, comprising:

emitters with acute tips;

gate electrodes each surrounding the acute tip of each emitter;

channel forming electrodes each formed over a cathode substrate;

each of said emitters being formed of a metal or metallic compound deposited or processed and formed on one end of each of said channel forming electrodes;

cathode electrodes each formed at the other end of each of said channel forming electrodes; and at least one current control electrode disposed between said emitters and each of said cathode electrodes to control a current flowing through each of said channel forming electrodes.

2. The field emission cathode as defined in claim 1, further comprising an insulating layer formed between each of said current control electrodes and each of said channel forming electrodes.

3. A field emission cathode, comprising:

emitters with acute tips;

gate electrodes each surrounding the acute tip of each emitter;

channel forming electrodes each formed over a cathode substrate;

each of said emitters being formed of a metal or metallic compound deposited or processed and formed on one end of each of said channel forming electrodes;

cathode electrodes each formed at the other end of each of said channel forming electrodes; and at least one current control electrode disposed between said emitters and each of said cathode electrodes to control a current flowing through each of said channel forming electrodes, wherein each of said channel forming electrodes is formed of a semiconductor thin film.

4. A field emission cathode, comprising:

a laminated cathode substrate on which a current control electrode, a first insulating layer, a cathode electrode, a channel forming electrode, a second insulating layer, and a gate electrode are sequentially laminated, said laminated cathode substrate having openings penetrating the gate electrode and said second insulating layer;

emitters each formed on said channel forming electrode exposed as the bottom surface in each of said openings; and a channel formed in a portion of said channel forming electrode confronting said current control electrode via said first insulating layer;

wherein a channel current flowing from said cathode electrode to said emitters via said channel forming electrode is controlled by adjusting a voltage applied to said current control electrode.

5. The field emission cathode as defined in claim 4, further comprising a plurality of stripe cathode electrodes and a plurality of stripe current control electrodes which are arranged in a matrix pattern, and an emitter array formed of plural emitters at an intersection of each cathode electrode and each current control electrode, said emitter array corresponding to a pixel.

6. A field emission cathode, comprising:

a laminated cathode substrate on which a current control electrode, a first insulating layer, a cathode electrode, a channel forming electrode, a second insulating layer, and a gate electrode are sequentially laminated, said laminated cathode substrate having openings penetrating the gate electrode and said second insulating layer;

emitters each formed on said channel forming electrode exposed as the bottom surface in each of said openings;

a channel formed in a portion of said channel forming electrode confronting said current control electrode via said first insulating layer, wherein a channel current flowing from said cathode electrode to said emitters via said channel forming electrode is controlled by adjusting a voltage applied to said current control electrode; and a plurality of stripe cathode electrodes and a plurality of stripe current control electrodes which are arranged in a matrix pattern, and an emitter array formed of plural emitters at an intersection of each cathode electrode and each current control electrode, said emitter array corresponding to a pixel, wherein an emission current of each of said plural emitters is modulation-controlled by the voltage of an analog or digital image signal applied to each of said current control electrodes.

7. A field emission cathode comprising:

a laminated cathode substrate formed of a channel forming electrode, a cathode electrode, an insulating layer, and a gate electrode which are sequentially formed on a cathode substrate, said laminated cathode substrate having openings penetrating said gate electrode and said insulating layer;

emitters each formed on said channel forming electrode exposed as the bottom surface in each of said openings;

a channel formed in a portion of said channel forming electrode;

a current control electrode confronting said channel on which said insulating layer is thinned;

wherein a channel current flowing from said cathode electrode to said emitters via said channel forming electrode is controlled by adjusting a voltage applied to said current control electrode.

8. The field emission cathode as defined in claim 7, further comprising a plurality of stripe cathode electrodes and a plurality of stripe current control electrodes which are arranged in a matrix pattern, and an emitter array formed of plural emitters at an intersection of each cathode electrode and each current control electrode.

9. A field emission cathode, comprising:

a laminated cathode substrate formed of a channel forming electrode, a cathode electrode, an insulating layer, and a gate electrode which are sequentially formed on a cathode substrate, said laminated cathode substrate having openings penetrating said gate electrode and said insulating layer;

emitters each formed on said channel forming electrode exposed as the bottom surface in each of said openings;

a channel formed in a portion of said channel forming electrode;

a current control electrode confronting said channel on which said insulating layer is thinned, wherein a channel current flowing from said cathode electrode to said emitters via said channel forming electrode is controlled by adjusting a voltage applied to said current control electrode; and a plurality of stripe cathode electrodes and a plurality of stripe current control electrodes which are arranged in a matrix pattern, and an emitter array formed of plural emitters at an intersection of each cathode electrode and each current control electrode, wherein an emission current of each of said plural emitters is modulation-controlled by the voltage of an analog or digital image signal applied to each of said current control electrodes.

10. A field emission cathode comprising:

a laminated cathode substrate formed of a channel forming electrode, a cathode electrode, an insulating layer, and a gate electrode which are sequentially formed on a substrate, said laminated cathode substrate having openings penetrating said gate electrode and said insulating layer;

emitters each formed on said channel forming electrode exposed as the bottom surface in each of said openings; and a current control electrode formed over a channel in said channel forming electrode and disposed between said emitter and said cathode electrode;

wherein a Schottky barrier is formed on an interface between said current control electrode and said channel forming electrode;

wherein a channel current flowing from said cathode electrode to said emitters via said channel forming electrode is controlled by adjusting a voltage applied to said current control electrode.

11. The field emission cathode as defined in claim 10, further comprising a plurality of stripe cathode electrodes and a plurality of stripe current control electrodes which are arranged in a matrix pattern, and an emitter array formed of plural emitters at an intersection of each cathode electrode and each current control electrode.

12. A field emission cathode, comprising:

a laminated cathode substrate formed of a channel forming electrode, a cathode electrode, an insulating layer, and a gate electrode which are sequentially formed on a substrate, said laminated cathode substrate having openings penetrating said gate electrode and said insulating layer;

emitters each formed on said channel forming electrode exposed as the bottom surface in each of said openings; and a current control electrode formed over a channel in said channel forming electrode and disposed between said emitter and said cathode electrode, wherein a Schottky barrier is formed on an interface between said current control electrode and said channel forming electrode, and wherein a channel current flowing from said cathode electrode to said emitters via said channel forming electrode is controlled by adjusting a voltage applied to said current control electrode; and a plurality of stripe cathode electrodes and a plurality of stripe current control electrodes which are arranged in a matrix pattern, and an emitter array formed of plural emitters at an intersection of each cathode electrode and each current control electrode, wherein an emission current of each of said plural emitters is modulation-controlled by the voltage of an analog or digital image signal applied to each of said current control electrodes.

13. A field emission cathode comprising:

a laminated cathode substrate formed of a current control electrode, a first insulating layer, a cathode electrode, a channel forming electrode, a second insulating layer, and a gate electrode which are sequentially formed on a cathode substrate, said laminated cathode substrate having openings penetrating said gate electrode and said second insulating layer;

emitters each formed on said channel forming electrode exposed as the bottom surface in each of said openings;

a channel formed in a portion of said channel forming electrode confronting said current control electrode via said first insulating layer;

wherein a current flowing said channel is controlled by a voltage applied to said current control electrode so that a current flowing from said cathode electrode to said emitter formed just above said channel via said channel forming electrode is controlled.

14. A field emission cathode comprising:

a laminated cathode substrate formed of a current control electrode, a first insulating layer, a cathode electrode, a channel forming electrode, a second insulating layer, and a gate electrode which are sequentially formed on a cathode substrate, said laminated cathode substrate having openings penetrating said gate electrode and said second insulating layer;

emitters each formed on said channel forming electrode exposed as the bottom surface in each of said openings;

said channel forming electrode formed of an I (intrinsic) semiconductor layer sandwiched between ohmic layers;

a channel formed in a portion of said channel forming electrode confronting said current control electrode via said first insulating layer;

wherein a current flowing said channel is controlled by a voltage applied to said current control electrode so that a current flowing from said cathode electrode to said emitter formed just above said channel via said channel forming electrode is controlled.

15. The field emission cathode as defined in claim 13 or 14, further comprising a plurality of stripe cathode electrodes and a plurality of stripe current control electrodes which are arranged in a matrix pattern, and an emitter array formed of plural emitters at an intersection of each cathode electrode and each current control electrode.

16. A field emission cathode, comprising:

a laminated cathode substrate formed of a current control electrode, a first insulating layer, a cathode electrode, a channel forming electrode, a second insulating layer, and a gate electrode which are sequentially formed on a cathode substrate, said laminated cathode substrate having openings penetrating said gate electrode and said insulating layer;

emitters each formed on said channel forming electrode exposed as the bottom surface in each of said openings;

a channel formed in a portion of said channel forming electrode confronting said current control electrode via said first insulating layer, wherein a current flowing said channel is controlled by a voltage applied to said current control electrode so that a current flowing from said cathode electrode to said emitter formed just above said channel via said channel forming electrode is controlled; and wherein an emission current of each of said plural emitters is modulation-controlled by the voltage of an analog or digital image signal applied to each of said current control electrodes.

17. A field emission cathode comprising:

a source formed of an - or P-type semiconductor region in a surface of a P- or N-type semiconductor substrate, and a drain formed of a - or P-type semiconductor region in a surface of said P- or N-type semiconductor substrate;

an emitter with an acute tip, formed on said drain;

an insulating layer formed on a surface of said semiconductor substrate, except at least said drain and said source;

a gate electrode formed on said insulating layer so as to surround the tip of said emitter;

a channel gate electrode formed on said insulating layer between said drain and said source;

a source electrode formed on said source; and an anode substrate spaced apart from said semiconductor substrate, said anode substrate being provided with anode electrodes overcoated with phosphor;

wherein a gradation of an image displayed on said anode substrate is controlled by an analog or digital image signal supplied to said channel gate electrode.

18. A field emission cathode, comprising:

a laminated cathode substrate formed of a current control electrode, a first insulating layer, a cathode electrode, a channel forming electrode, a second insulating layer, and a gate electrode which are sequentially formed on a cathode substrate, said laminated cathode substrate having openings penetrating said gate electrode and said second insulating layer;

emitters each formed on said channel forming electrode exposed as the bottom surface in each of said openings;

said channel forming electrode formed of an I (intrinsic) semiconductor layer sandwiched between ohmic layers;

a channel formed in a portion of said channel forming electrode confronting said current control electrode via said first insulating layer, wherein a current flowing said channel is controlled by a voltage applied to said current control electrode so that a current flowing from said cathode electrode to said emitter formed just above said channel via said channel forming electrode is controlled; and a plurality of stripe cathode electrodes and a plurality of stripe current control electrodes which are arranged in a matrix pattern, and an emitter array formed of plural emitters at an intersection of each cathode electrode and each current control electrode, wherein an emission current of each of said plural emitters is modulation-controlled by the voltage of an analog or digital image signal applied to each of said current control electrodes.

* * * * *

UNITED STATES PATENT AND TRADEMARK OFFICE

CERTIFICATE OF CORRECTION

PATENT NO. : 6,163,107
DATED : December 19, 2000
INVENTOR(S) : Shigeo Itoh, et al.

It is certified that error appears in the above-identified patent and that said Letters Patent is hereby corrected as shown below:

Title page, item [30],
Foreign Application Priority Data is incorrectly listed. Item [30] should read as follows:

-- [30] Foreign Application Priority Data

| | | | |
|---|---|---|---|
| Mar. 11, 1997 | [JP] | Japan | 9-072841 |
| Aug. 11, 1997 | [JP] | Japan | 9-216160 |

Signed and Sealed this

Twenty-third Day of October, 2001

*Attest:*

Nicholas P. Godici

*Attesting Officer*

NICHOLAS P. GODICI
*Acting Director of the United States Patent and Trademark Office*